US010408561B1

(12) United States Patent
Liu

(10) Patent No.: US 10,408,561 B1
(45) Date of Patent: Sep. 10, 2019

(54) DEVICE FOR A CROSSBOW

(71) Applicant: Chi-Chang Liu, Taichung (TW)

(72) Inventor: Chi-Chang Liu, Taichung (TW)

(73) Assignee: POE LANG ENTERPRISE CO., LTD., Taichung ( * ) Notice: Subject to any disclaimer, the term of this patent is extended or adjusted under 35 U.S.C. 154(b) by 0 days.

(21) Appl. No.: 16/199,229

(22) Filed: Nov. 26, 2018

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01)

(58) Field of Classification Search
CPC ..... F41B 5/12; F41B 5/123
See application file for complete search history.

(56) References Cited

U.S. PATENT DOCUMENTS 3,670,711 A * 6/1972 Firestone ..... F41B 5/12 124/25
3,783,852 A * 1/1974 Shepherd ..... F41B 5/12 124/22
4,649,892 A * 3/1987 Bozek ..... F41B 5/10 124/25
4,827,894 A * 5/1989 Schallberger ..... F41B 5/12 124/25
4,942,861 A * 7/1990 Bozek ..... F41B 5/12 124/25
5,215,069 A * 6/1993 Liu ..... F41B 5/12 124/25

* cited by examiner

*Primary Examiner* — John A Ricci

(57) ABSTRACT

A crossbow includes a barrel with a bow connected to the top thereof, a handle cooperated with a trigger, a retention unit and a cocking device. The cocking device includes two slots respectively defined in two sides of the barrel and each slot includes a holding member slidably located therein. A link unit is connected between the two holding members and barrel. The holding members are moved toward the front end of the barrel to hook the string, and the holding members are moved toward the rear end of the barrel to hook the string to the stop member of the retention unit by operation of the link unit. When pulling the trigger, the stop plate moves downward to release the string to shoot the arrow.

7 Claims, 12 Drawing Sheets

DEVICE FOR A CROSSBOW

BACKGROUND OF THE INVENTION

1. Fields of the Invention

The present invention relates to a cocking device for a crossbow, and more particularly, to a cocking device that is safe and easily operated.

2. Descriptions of Related Art

A conventional crossbow generally includes a barrel with a handle located at the rear end thereof, and a bow is located on the top of the barrel. A retention unit is located on the top of the rear end of the barrel. An arrow is installed to an arrow track on the top of the barrel and is engaged with the string of the bow. The user pulls the string backward to store energy, when the user pulls the trigger, the string is released to send the arrow forward.

The user has to pull the string with sufficient force so that the string can be secured before the trigger is pulled. Once the user does not pull the string with sufficient force, the string may bounce back and injures the user and other people.

Therefore, a cocking device is used to assist the user to easily pull the string backward and to secure the string before the trigger is pulled. However, most of the cocking device includes too many parts and a complicated structure.

The present invention intends to provide a cocking device that eliminates the shortcomings mentioned above.

SUMMARY OF THE INVENTION

The present invention relates to a crossbow and comprises a barrel having a front end and a rear end, and a bow is located on the top of the barrel and close to the front end. A string is connected to the how. A handle is located at the underside of the rear end of the barrel. A track plate is located on the top of the barrel and has an arrow track. A retention unit is located on the top of the barrel. A trigger is located in front of the handle and located beneath the retention unit. The retention unit has a stop plate which is pivotable and movable up and down. The stop plate is connected to the trigger and restricts the stop plate from moving downward. A cocking device includes a slot defined in each of two sides of the barrel. A holding member is located in each of the two slots. A link unit is connected to the barrel and the holding members so as to operate the holding members back and forth in the slots. When the holding members move from the front end toward the rear end, the string is driven by the holding members and engaged with the stop plate.

Preferably, each of the slots includes an engaging end located close to the front end of the barrel, and a release end located close to the rear end of the barrel. The release end includes a descending section. The holding members are moved by the link unit into the descending section and disengaged from the string so as to hook the to the stop plate.

Preferably, the holding members each include a recess and a guide portion. The guide portion faces the string and the recess is located opposite to the guide portion. The string moves along the guide portion and is engaged with the recess.

Preferably, the guide portion is a protruded and curved face.

Preferably, the holding members each include at least one slider which is located in the slot corresponding thereto.

Preferably, when the holding members move to the rear end of the barrel the link unit, the holding members control the holding members to pivot an angle to disengage the string from the holding members, and the string is engaged with the stop plate.

Preferably, the link unit includes two end links, a first link, a second link and a lever. The first end of each of the two end links is pivotably connected to the holding member corresponding thereto by a first pin. A bar is pivotably connected between two respective second ends of the two end links and two respective first ends of the first links. Two respective second ends of the first links are pivotably connected to two respective first ends of the second links by two second pins. Two respective second ends of the second links are pivotably connected to the front end of the barrel by two third pins. A second end of the lever is pivotably connected to the front end of the barrel by a third pin. A first end of the lever has a hook pivotably connected thereto. The hook is detachably connected to a rod located at the lower end of the handle. The lever is pivotably connected to an axial slot in the second link.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 11:
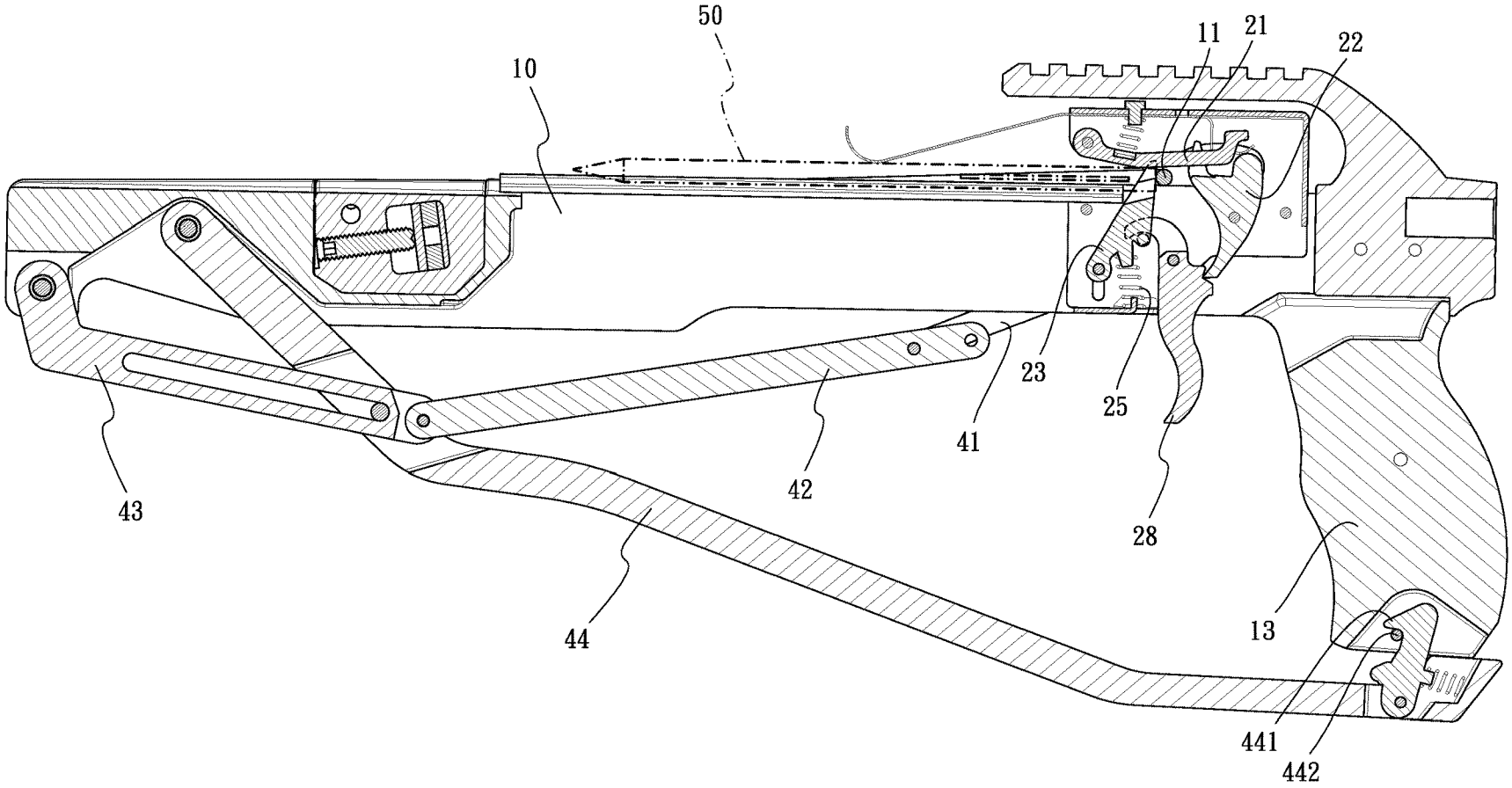
FIG. 11 is a side cross sectional view to show that an arrow is positioned in the arrow track.

Referring to FIGS. 1 to 12, the crossbow of the present invention comprises a barrel 10 having a front end 101 and a rear end 102. A bow 12 is connected to a frame 121 which is fixed on the top of the barrel 10 and located close to the front end 101. A string 11 is connected to the bow 12. A handle 13 is located at the underside of the rear end 102 of the barrel 10. A track plate 14 is located on the top of the barrel 10 and has an arrow track 141 so that an arrow 50 is put in the arrow track 141 as shown in FIG. 11.

Figure 2:
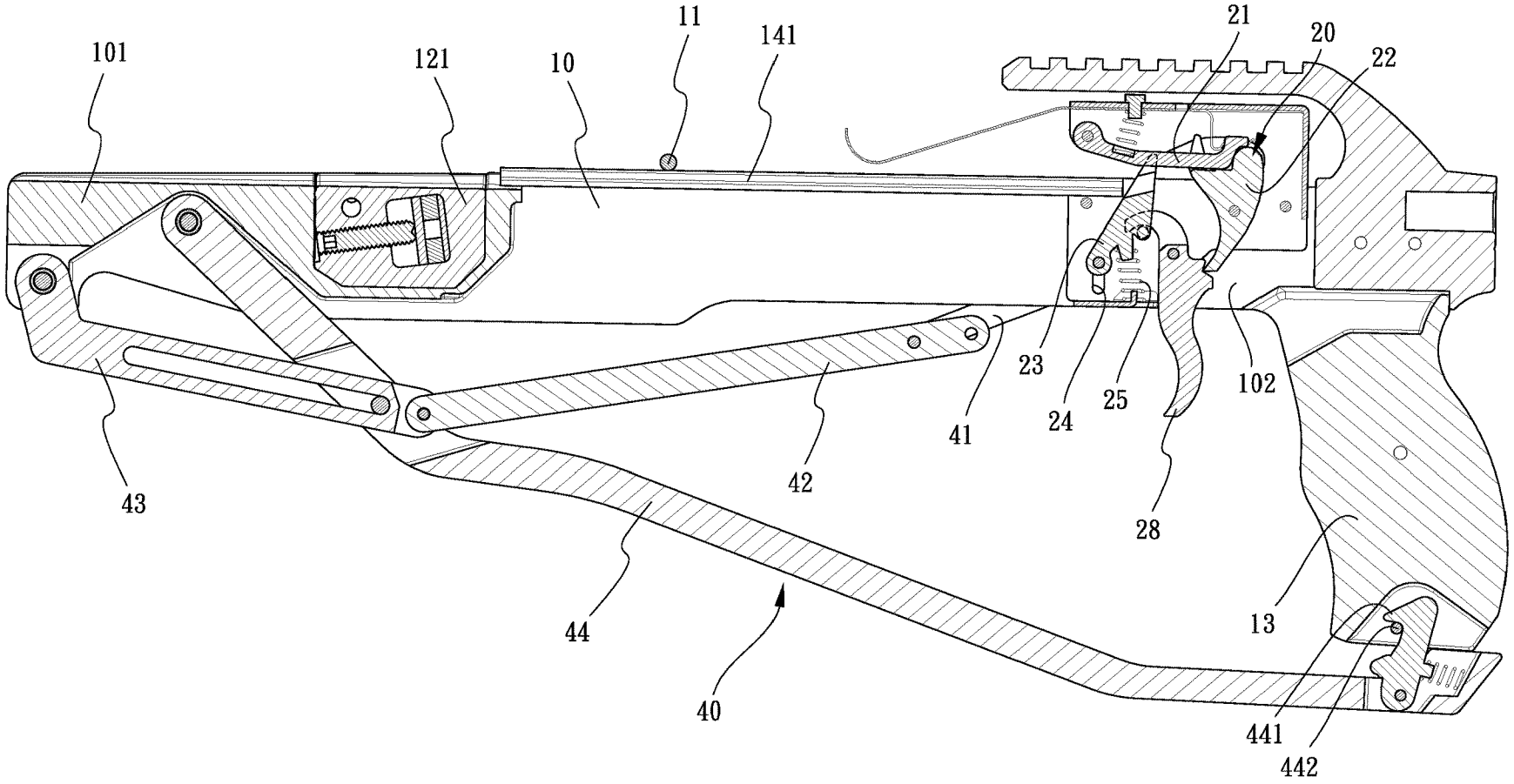
FIG. 2 is a cross sectional view, taken along line II-II of FIG. 1.

A retention unit 20 is located on the top of the barrel 10, and the track plate 14 is located between the bow 12 and the retention unit 20. A trigger 28 is located in front of the handle 13 and located beneath the retention unit 20. The retention unit 20 includes a safety plate 21, a safety member 22, and a stop plate 23 which is pivotable and movable up and down. As shown in FIG. 2 which shows that the crossbow is in a safety status, wherein the safety plate 21 restricts or releases the safety member 22. The safety member 22 restricts or releases the trigger 28. The stop plate 23 is connected to the trigger 28 and restricts the stop plate 23 from moving downward. The stop plate 23 is pivotably located in an elongate hole 24 in the barrel 10. A spring 25 is connected to the barrel 10 and biases the underside of the stop plate 23 so that the stop plate 23 is movable up and down, and pivotable about a pin extending through the stop plate 23.

Figure 1:
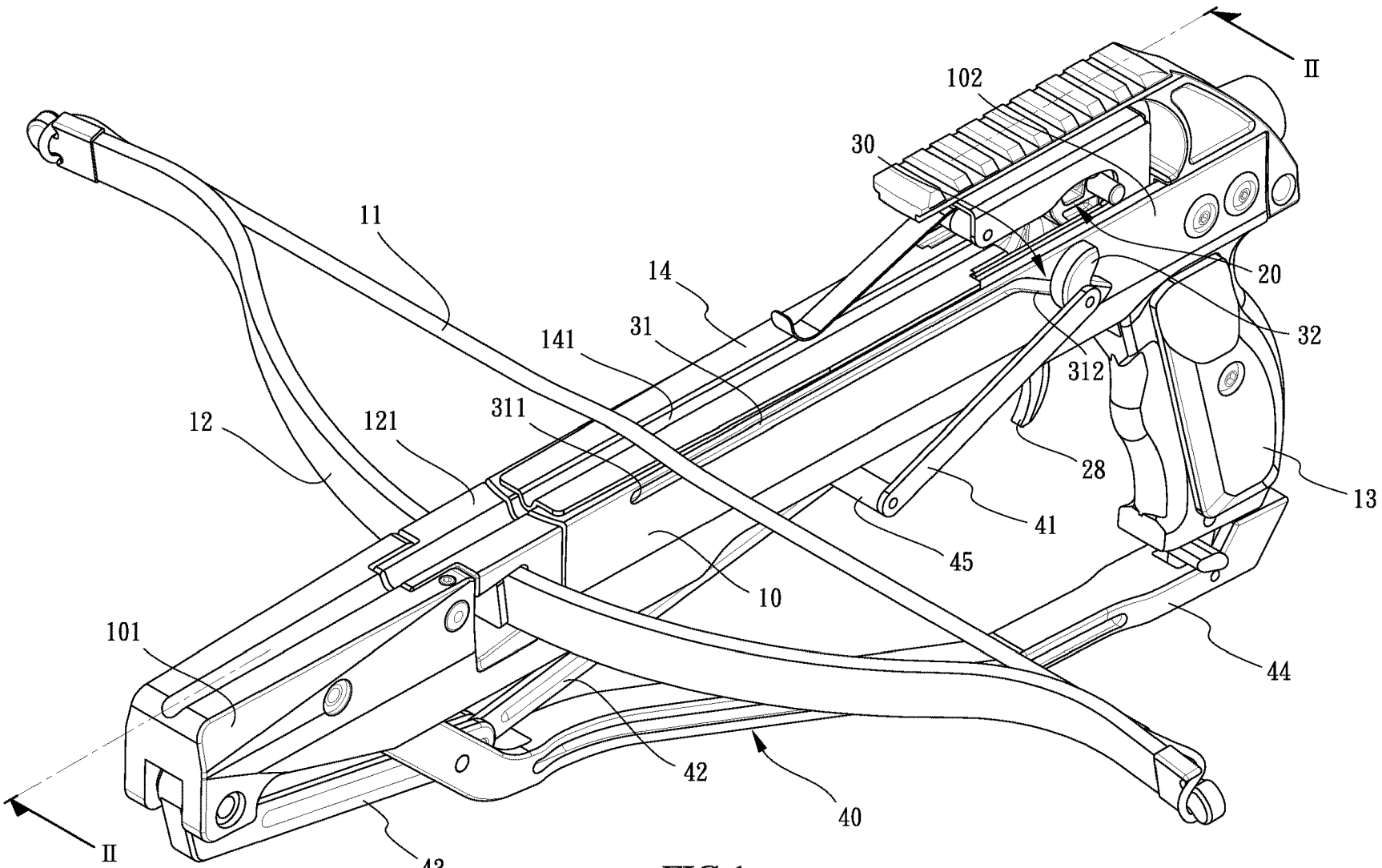
FIG. 1 is a perspective view to show the crossbow of the present invention.
Figure 3:
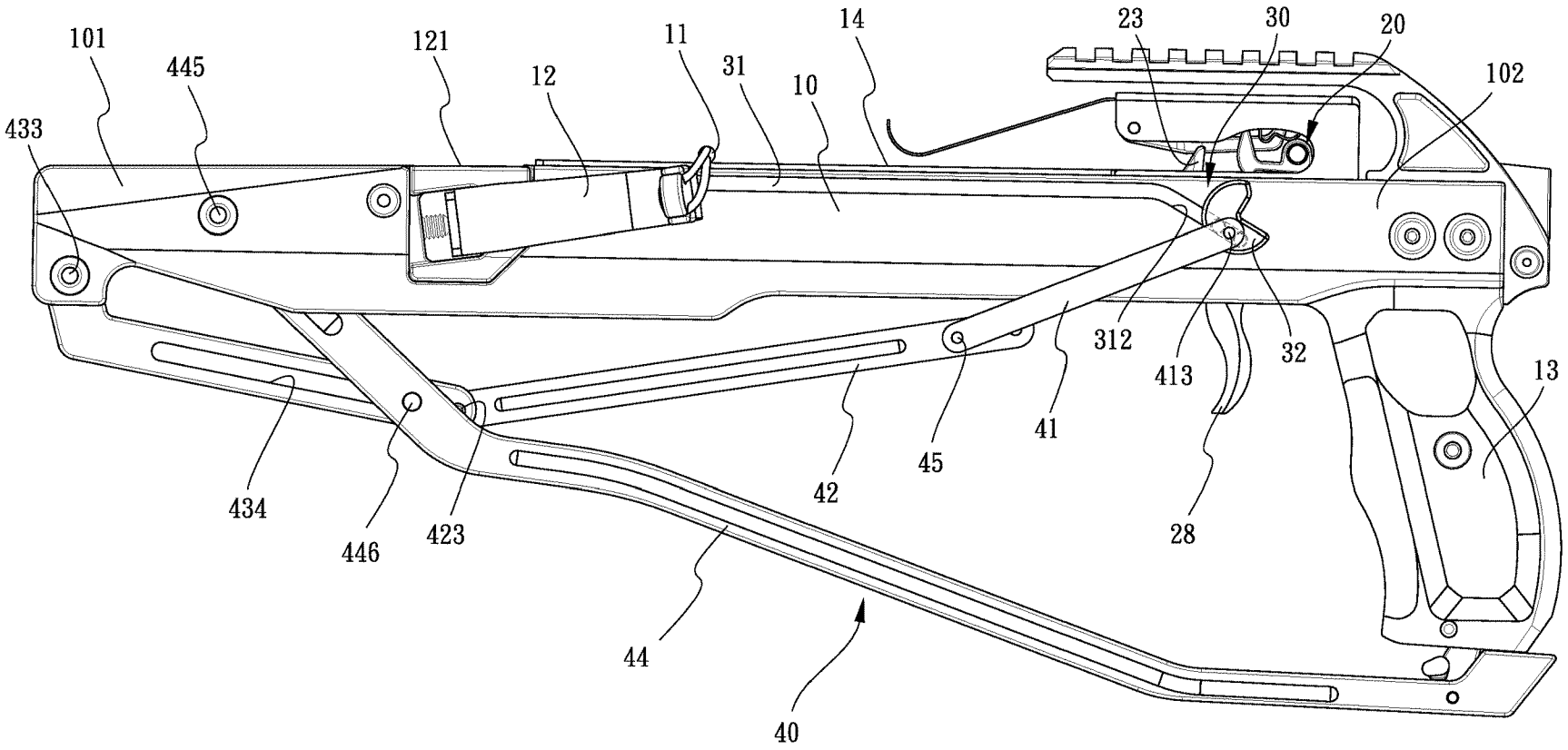
FIG. 3 is a side view of the crossbow of the present invention.
Figure 5:
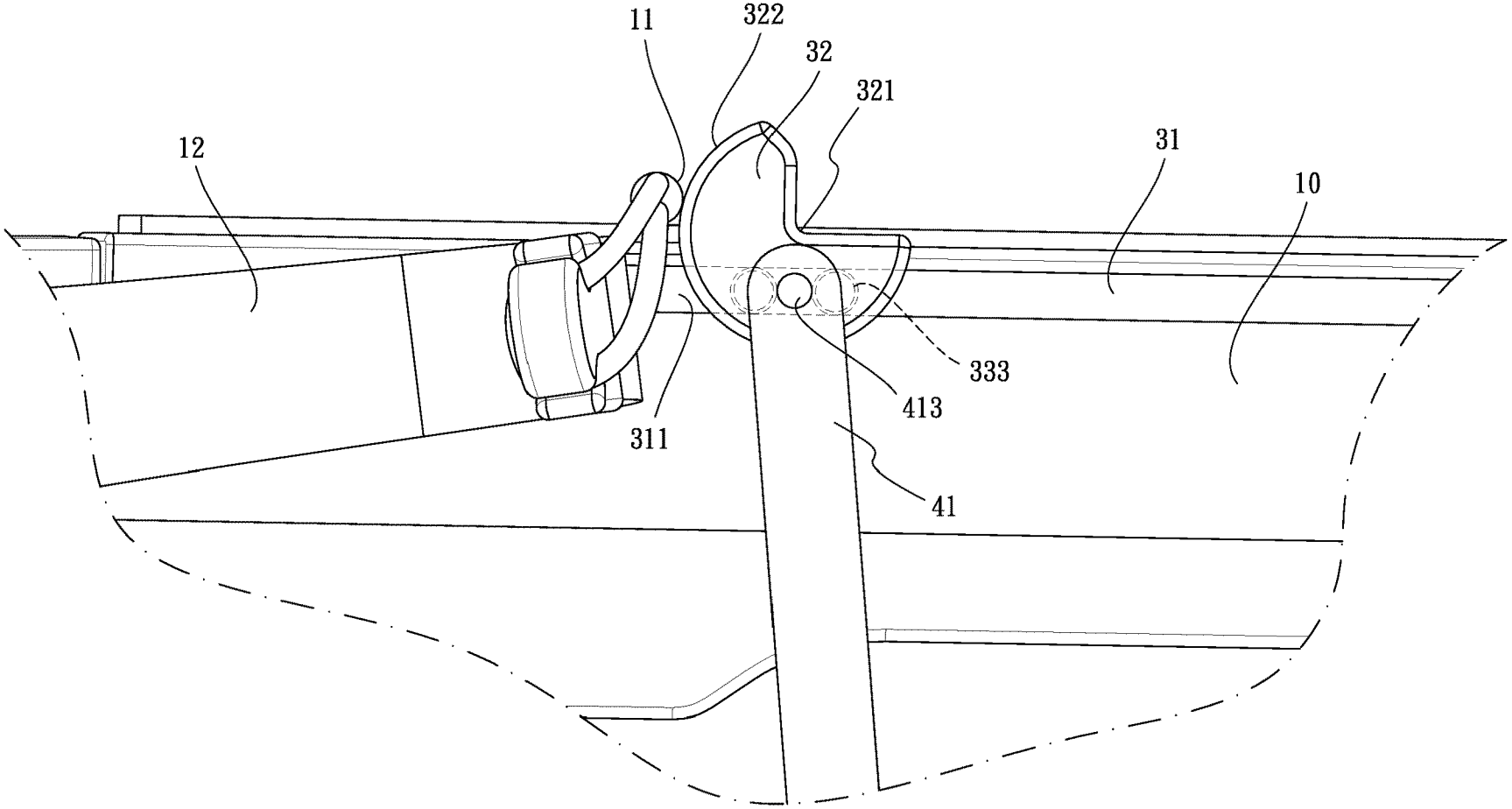
FIG. 5 is an enlarged view to show that the string is about to move over the holding member.

As shown in FIGS. 1, 3 and 5, a cocking device 30 includes a slot 31 defined in each of two sides of the barrel 10, and a holding member 32 is located in each of the two slots 31. Specifically, each of the slots 31 includes an engaging end 311 located close to the front end 101 of the barrel 10, and a release end 322 located close to the rear end 102 of the barrel 10, the release end 322 includes a descending section.

A link unit 40 is connected to the barrel 10 and the holding members 32 so as to operate the holding members 32 back and forth in the slots 31. The link unit 40 includes two end links 41, a first link 42, a second link 43 and a lever 44. The first end of each of the two end links 41 is pivotably connected to the holding member 32 corresponding thereto by a first pin 413. A bar 45 is pivotably connected between two respective second ends of the two end links 41 and two respective first ends of the first links 42. Two respective second ends of the first links 42 are pivotably connected to respective first ends of the second links 43 by two second pins 423. Two respective second ends of the second links 43 are pivotably connected to the front end 101 of the barrel 10 by two third pins 433. The second end of the lever 44 is pivotably connected to the front end 101 of the barrel 10 by a third pin 445. The first end of the lever 44 has a hook 441 pivotably connected thereto. The hook 441 is detachably connected to a rod 442 located at the lower end of the handle 13. The lever 44 is pivotably connected to an axial slot 434 in the second link 43. Specifically, when the holding members 32 move from the front end 101 toward the rear end 102, the string 11 is driven by the holding members 32 and engaged with the stop plate 23. The holding members 32 are moved by the link unit 40 into the descending section to disengage from the string 11, so that the string 11 hooks the stop plate 23. When the string 11 hooks the stop plate 23, energy is stored and the crossbow is under a stand-by status.

The holding members 32 each include a recess 321 and a guide portion 322. The guide portion 322 faces the string 11 and the recess 321 is located opposite to the guide portion 322. The guide portion 322 is a protruded and curved face so that the string 11 is able to move along the guide portion 322 and is engaged with the recess 321. The holding members 32 each include at least one slider 333 which is located in the slot 31 corresponding thereto.

As shown in FIG. 3, the lever 44 is engaged with the rod 442 of the handle 13 by the hook 441 of the lever 44, and the link unit 40 is in a folded position. The end link 41, the first and second links 42, 43 position the holding members 32 at the release ends 312 of the slots 31.

Figure 4:
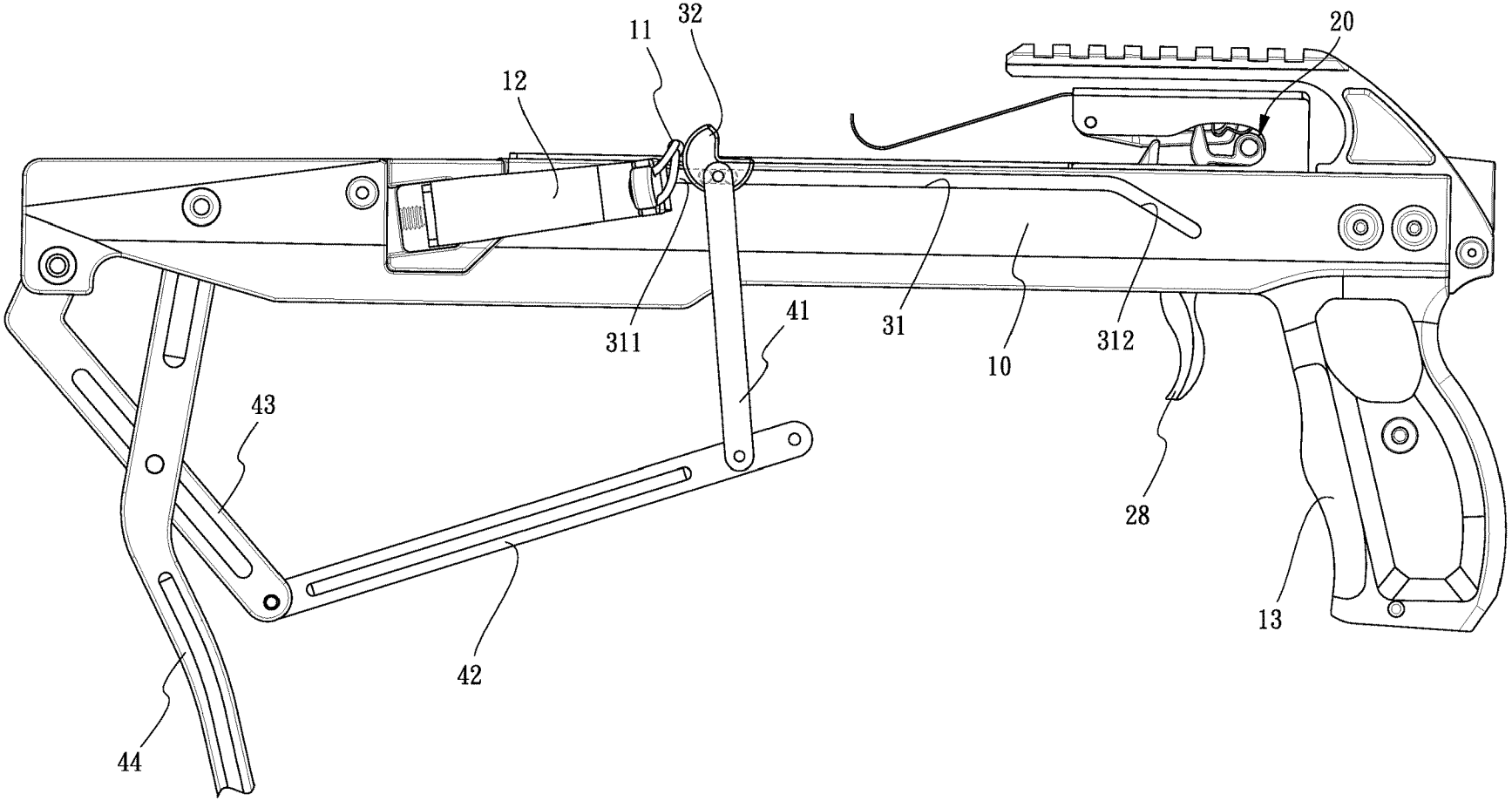
FIG. 4 is a side view to show that the lever is pivoted.
Figure 6:
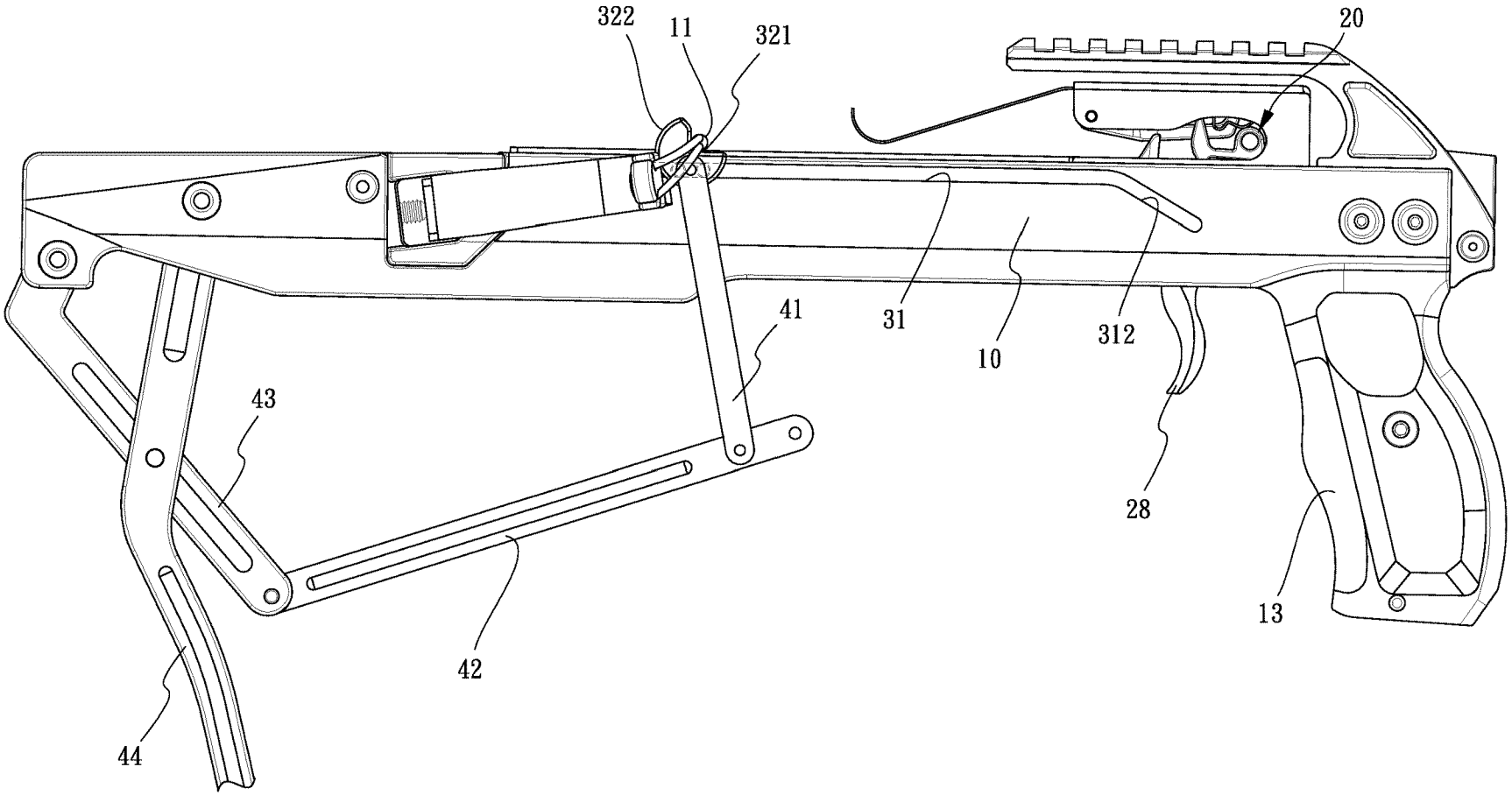
FIG. 6 shows that the string is moved over the holding member and engaged with the recess of the holding member.
Figure 7:
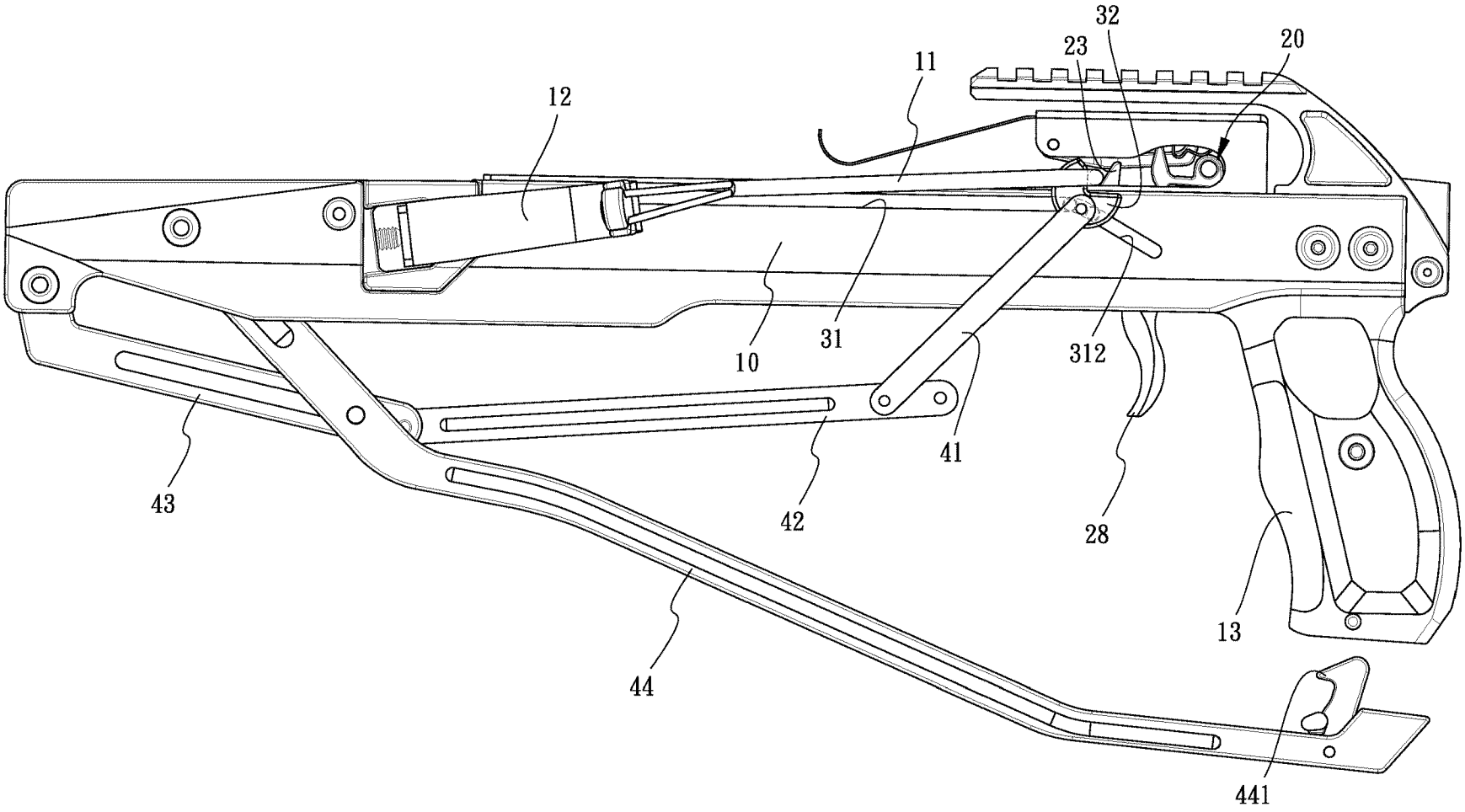
FIG. 7 shows that the holding member is moved toward the stop plate.
Figure 8:
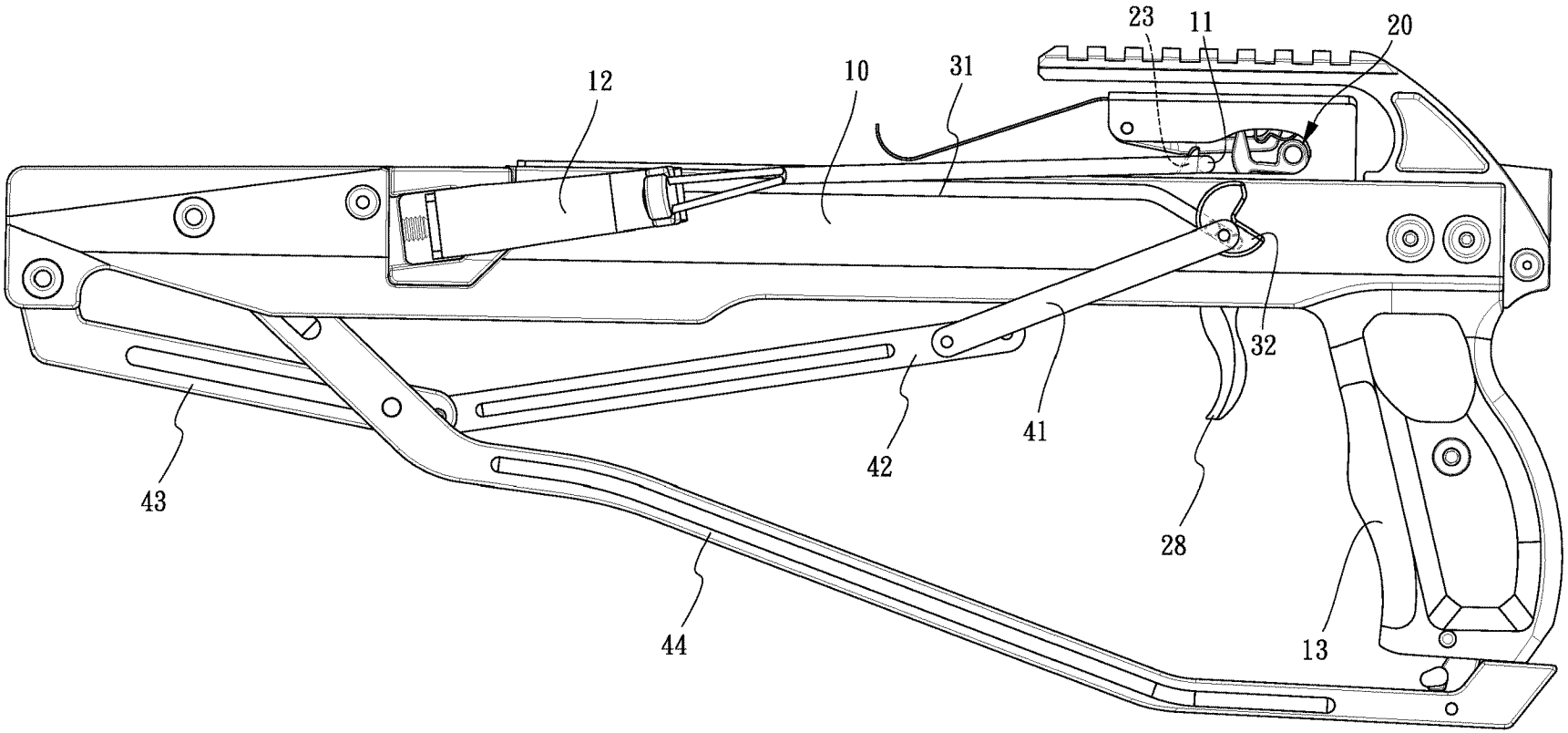
FIG. 8 shows that the holding member is moved downward and the string is hooked to the stop plate.
Figure 9:
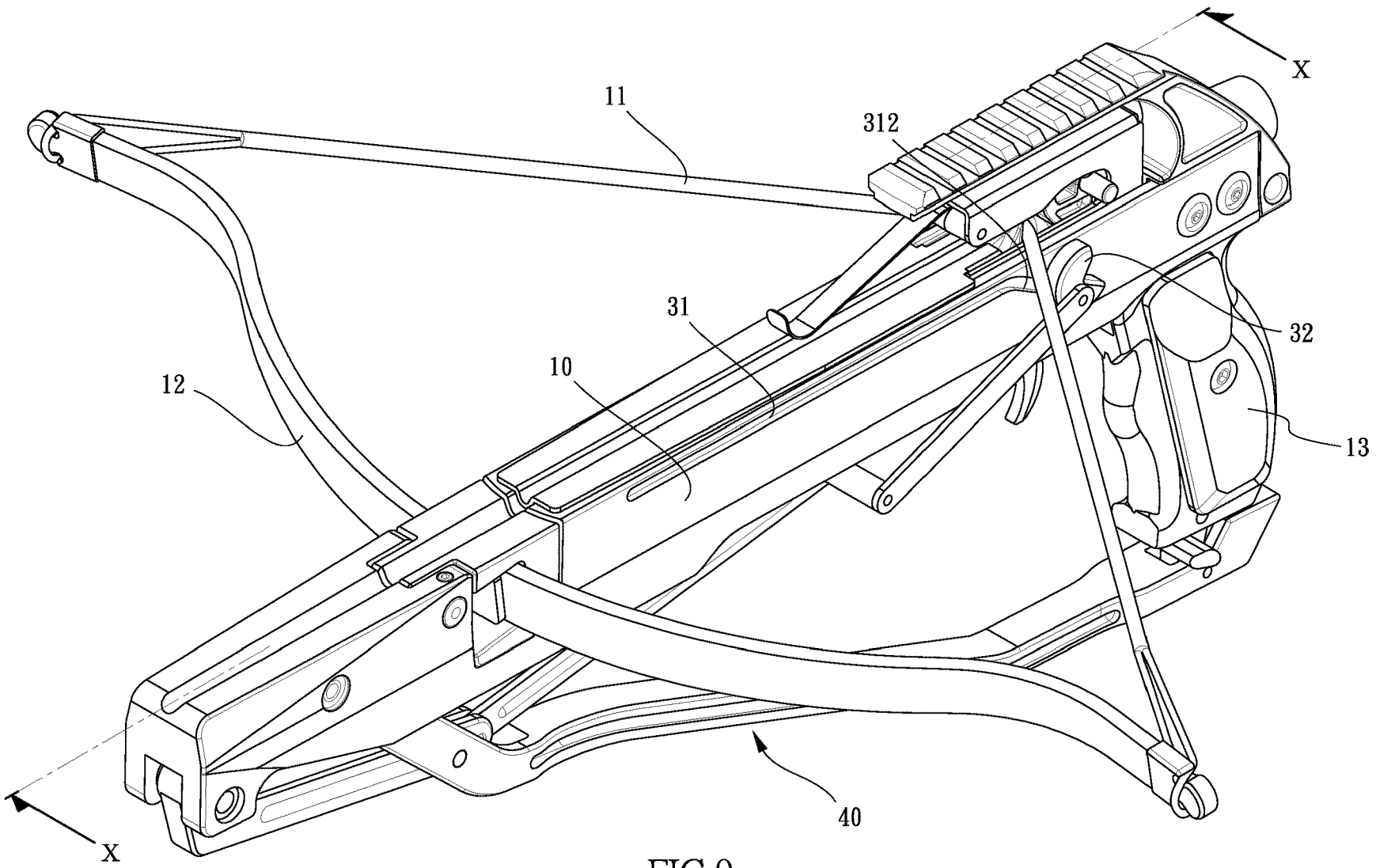
FIG. 9 shows a perspective view to show the string is positioned to the stand-by position.
Figure 10:
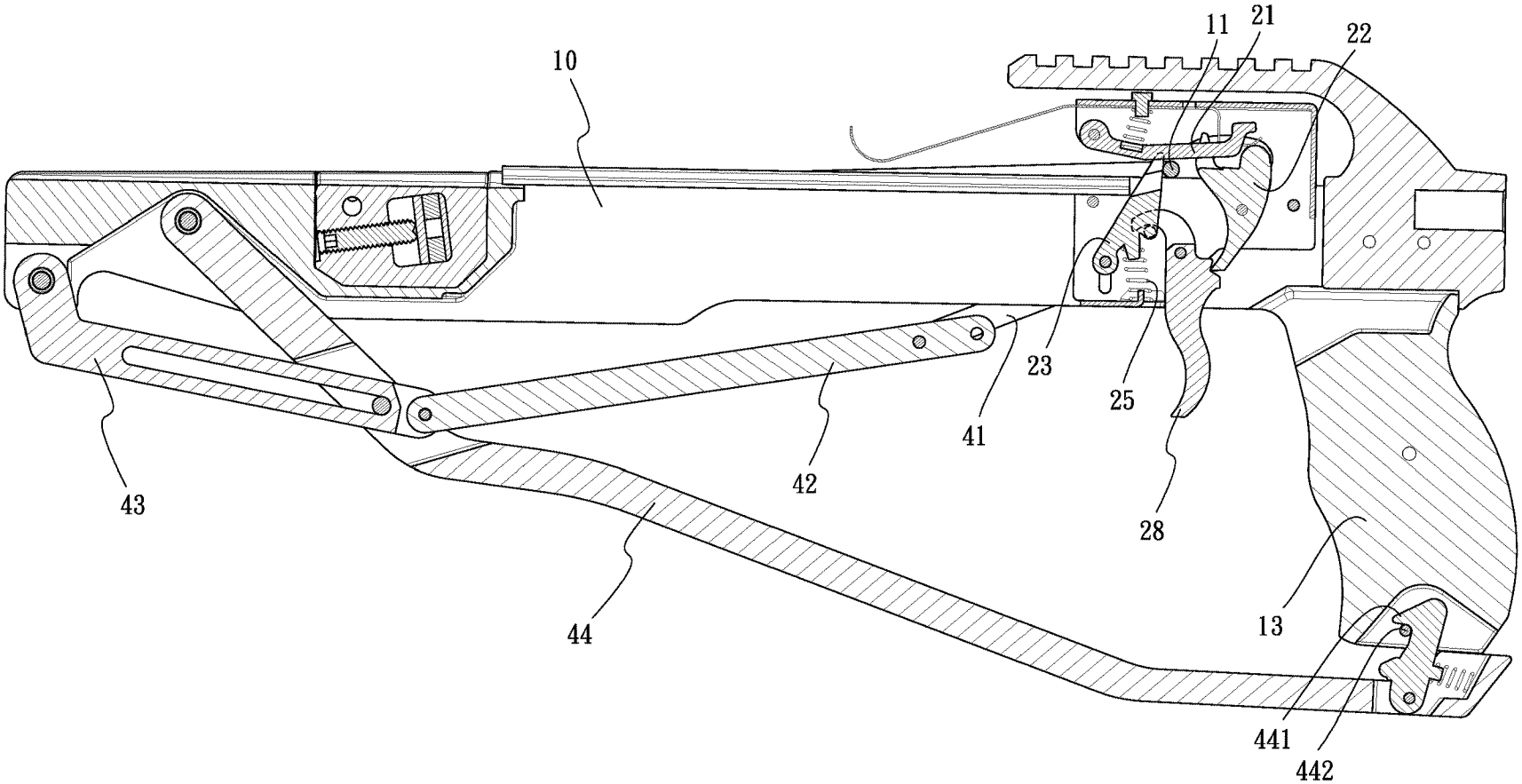
FIG. 10 is a side cross sectional view, taken along line X-X of FIG. 9.

As shown in FIGS. 4 to 6, when releasing the hook 441 from the rod 442, the lever 44 can be pivoted toward the front end 101 of the barrel 10. The lever 44 drives the second link 43, the first link 42 and the end link 41, so that the holding members 32 move from the release ends 312 to the engaging end 311 of the slots 31. The holding members 32 use the guide portion 322 to push the string 11, and guides the string 11 into the recesses 231 of the holding members 32.

As shown in FIGS. 7 to 10, the lever 44 is pivoted toward the rear end 102 of the barrel 10, and the lever 44 drives the second link 43, the first link 42 and the end link 41 so that the holding members 32 move from the engaging end 311 to the release end 312 of the slots 31. The holding members 32 also drag the string 11 to pull the string 11 toward the rear end 102 of the barrel 10. When the string 11 touches the stop plate 23, the stop plate 23 is pushed downward by the string 11, and the string 11 moves over the stop plate 23 and stop plate 23 moves back by the spring 25. The holding members 32 enter into the release ends 312 of the slots 31. Because the release ends 312 each include a descending section so that the holding members 32 move along the descending sections and disengage from the string 11 which then hooks to the stop plate 23.

Figure 12:
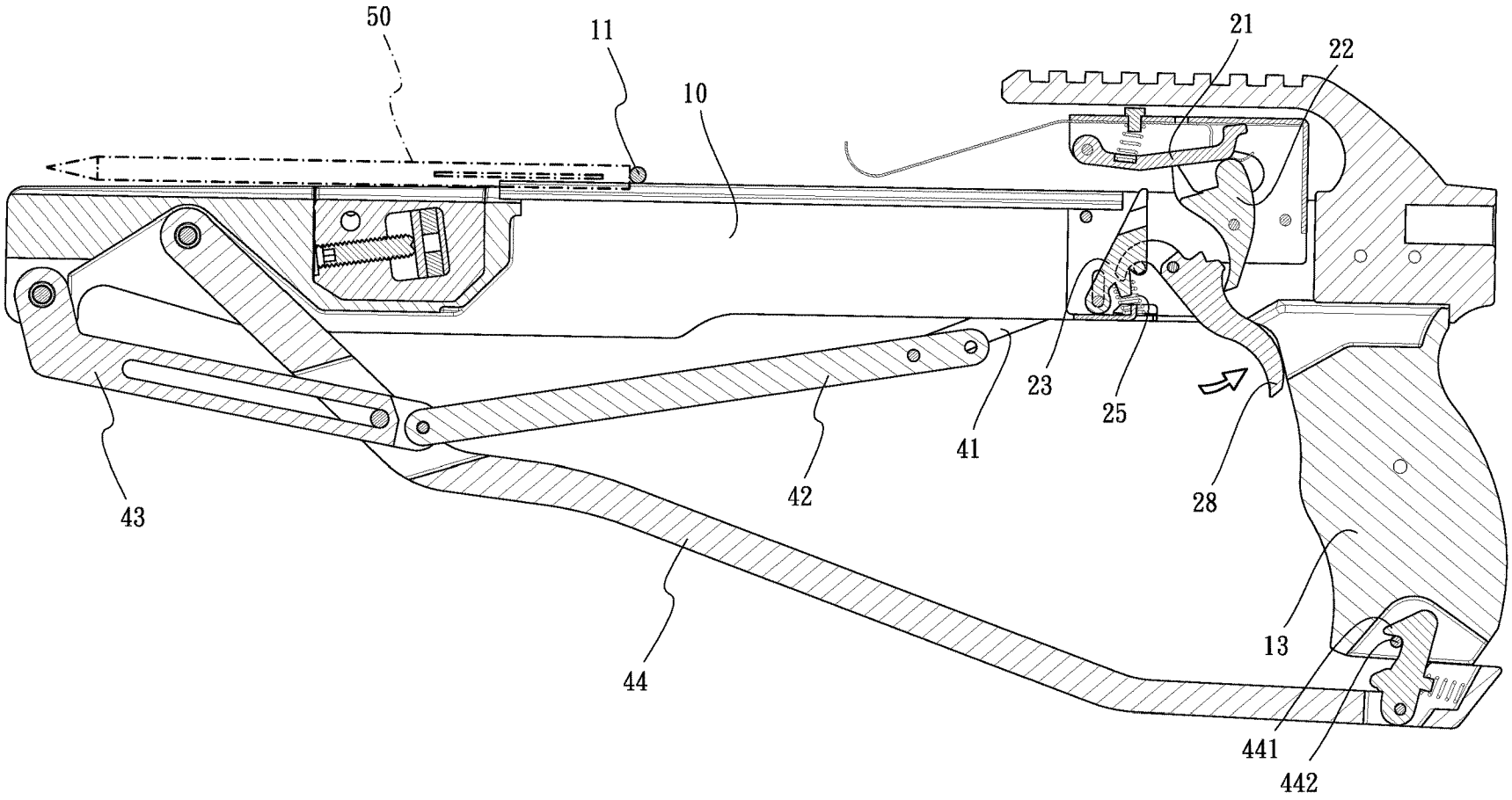
FIG. 12 is a side cross sectional view to show that the arrow shoots out when the trigger is pulled.

As shown in FIGS. 11 and 12, the user then puts an arrow 50 to the arrow track 141 of the track plate 14. The string 11 and the arrow 50 push the safety plate 21 upward. When the safety plate 21 releases the safety member 22, the safety member 22 releases the trigger 28 so that the safety status of the retention unit 20 is released. The user pulls the trigger 28 and the stop plate 23 is lowered to release the string 11, the string 11 quickly bounces forward, and the arrow 50 is sent by the energy stored by the string 11.

There is another way to hook the string 11 to the stop plate 23, which is that the link unit 40 controls the holding members 32 to pivot an angle at the release ends 312 of the slots 31 so that the recess 321 of each holding members 32 faces the stop plate 23 to disengage the string 11 from the holding members 32, and the string 11 is engaged with the stop plate 23.

While we have shown and described the embodiment in accordance with the present invention, it should be clear to those skilled in the art that further embodiments may be made without departing from the scope of the present invention.

What is claimed is:

1. A crossbow comprising:

a barrel having a front end and a rear end, a bow located on a top of the barrel and close to the front end, a string connected to the bow, a handle located at an underside of the rear end of the barrel, a track plate located on the top of the barrel and having an arrow track, a retention unit located on the top of the barrel, the track plate located between the bow and the retention unit, a trigger located in front of the handle and located beneath the retention unit, the retention unit having a stop plate which is pivotable and movable up and down, the stop plate connected to the trigger and restricting the stop plate from moving downward, and a cocking device including a slot defined in each of two sides of the barrel, a holding member located in each of the two slots, a link unit connected to the barrel and the holding members so as to operate the holding members back and forth in the slots, when the holding members move from the front end toward the rear end, the string is driven by the holding members and engaged with the stop plate.

2. The crossbow as claimed in claim 1, wherein each of the slots includes an engaging end located close to the front end of the barrel, and a release end located close to the rear end of the barrel, the release end includes a descending section, the holding members are moved by the link unit into the descending section and disengaged from the string to hook the string to the stop plate.

3. The crossbow as claimed in claim 1, wherein the holding members each include a recess and a guide portion, the guide portion faces the string and the recess is located opposite to the guide portion, the string moves along the guide portion and is engaged with the recess.

4. The crossbow as claimed in claim 3, wherein the guide portion is a protruded and curved face.

5. The crossbow as claimed in claim 1, wherein the holding members each include at least one slider which is located in the slot corresponding thereto.

6. The crossbow as claimed in claim 1, wherein when the holding members move to the rear end of the barrel, the link unit controls the holding members to pivot an angle to disengage the string from the holding members, and the string is engaged with the stop plate.

7. The crossbow as claimed in claim 1, wherein the link unit includes two end links, a first link, a second link and a lever, a first end of each of the two end links is pivotably connected to the holding member corresponding thereto by a first pin, a bar is pivotably connected between two respective second ends of the two end links and two respective first ends of the first links, two respective second ends of the first links are pivotably connected to respective first ends of the second links by two second pins, two respective second ends of the second links are pivotably connected to the front end of the barrel by two third pins, a second end of the lever is pivotably connected to the front end of the barrel by a third pin, a first end of the lever has a hook pivotably connected thereto, the hook is detachably connected to a rod located at a lower end of the handle, the lever is pivotably connected to an axial slot in the second link.

* * * * *